US007750565B2

(12) United States Patent
Yim

(10) Patent No.: US 7,750,565 B2
(45) Date of Patent: Jul. 6, 2010

(54) PLASMA DISPLAY PANEL WITH A REDUCED NUMBER OF ELECTRODES

(75) Inventor: Sang-Hoon Yim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 1069 days.

(21) Appl. No.: 11/438,803

(22) Filed: May 22, 2006

(65) Prior Publication Data

US 2006/0267497 A1 Nov. 30, 2006

(30) Foreign Application Priority Data

May 27, 2005 (KR) ..... 10-2005-0045187

(51) Int. Cl.
*H01J 17/00* (2006.01)
*G09G 3/28* (2006.01)

(52) U.S. Cl. ..... 313/581; 313/582; 313/584; 313/585; 345/67

(58) Field of Classification Search ..... 313/582–587
See application file for complete search history.

(56) References Cited

U.S. PATENT DOCUMENTS 6,972,527 B2 * 12/2005 Su et al. ..... 315/169.4
7,230,378 B2 * 6/2007 Su ..... 313/583
2002/0021090 A1 2/2002 Sano et al.
2002/0047592 A1 4/2002 De Zwart et al.
2005/0057172 A1 3/2005 Su et al.
2005/0194902 A1 * 9/2005 Su ..... 313/585

FOREIGN PATENT DOCUMENTS

JP 2001176405 A * 6/2001

OTHER PUBLICATIONS

European Search Report dated Oct. 16, 2006, for EP 06114580.1, in the name of Samsung SDI Co., Ltd.

* cited by examiner

*Primary Examiner*—Sikha Roy
(74) *Attorney, Agent, or Firm*—Christie, Parker & Hale, LLP

(57) ABSTRACT

A plasma display panel having an enhanced arrangement of pixels and electrodes enabling higher integration of pixels. A front substrate and a rear substrate are formed having opposing surfaces and a plurality of discharge cells are partitioned in a space therebetween. A plurality of address electrodes are formed along a first direction between the front and rear substrates. A plurality of display electrodes are formed along a second direction between the front and rear substrates and are electrically separated from the plurality of address electrodes. At least two discharge cells among a plurality of discharge cells included in respective pixels correspond to and are driven by a same address electrode.

33 Claims, 6 Drawing Sheets

PLASMA DISPLAY PANEL WITH A REDUCED NUMBER OF ELECTRODES

CROSS-REFERENCE TO RELATED APPLICATION

This application claims priority to and the benefit of Korean Patent Application No. 10-2005-0045187 filed in the Korean Intellectual Property Office on May 27, 2005, the entire content of which is incorporated herein by reference.

BACKGROUND OF THE INVENTION (a) Field of the Invention

The present invention relates to a plasma display panel (PDP). More particularly, the present invention relates to a PDP having an enhanced arrangement of pixels and electrodes that enables higher integration of pixels.

(b) Description of the Related Art

Generally, a PDP is a display device which excites phosphors with vacuum ultraviolet rays radiated from plasma obtained through gas discharging, and displays desired images by visible light such as red (R), green (G), and blue (B) colors generated by the excited phosphors. The PDP has been spotlighted as a flat panel display for television and industrial purposes with several advantages. The PDP can realize a very large screen size of 60" or more with a thickness of 10 cm or less, and involves excellent color representation, without image distortion due to viewing angles, since it is a self emissive display, such as a cathode ray tube (CRT). The PDP further involves high productivity and low production cost as it is made in a more simplified manner as compared to a liquid crystal display (LCD).

A three-electrode surface-discharge type of PDP may be considered as an example of a typical PDP. The three-electrode surface-discharge type of PDP includes a first substrate having sustain electrodes and scan electrodes on the same surface, and a second substrate disposed apart from the first substrate by a predetermined distance and having address electrodes elongated perpendicular to the direction of the sustain and scan electrodes. A discharge gas is filled between the two substrates of the PDP. For each discharge cell of the PDP, whether the discharge cell will be discharged is determined by a discharge between the scan electrode and address electrode corresponding thereto, and a sustain discharge that actually displays a required image occurs between the sustain electrode and scan electrode formed on the same plane.

FIG. 5 and FIG. 6 are top plan views illustrating exemplary arrangements of pixels and electrodes in conventional PDPs. FIG. 5 shows a stripe structure of barrier ribs of a PDP, and FIG. 6 shows a delta structure of barrier ribs of a PDP. FIG. 5 and FIG. 6 respectively illustrate only partial views of display areas of PDPs, and thus it should be understood that the indices n and m in FIGS. 5 and 6 may respectively indicate arbitrary integers.

As shown in FIG. 5, in the PDP with the stripe structure of barrier ribs, discharge cells are respectively formed between sustain electrodes Xn to Xn+3 and scan electrodes Yn to Yn+3 that are disposed opposing each other, forming a discharge gap therebetween. Each pixel 61 of such a PDP includes three adjacent discharge cells 61R, 61G, 61B of respectively red, green, and blue colors. Address electrodes 65 are formed to cross corresponding discharge cells among the discharge cells 61R, 61G, 61B forming the pixels 61.

Therefore, regarding sixteen pixels 61 shown in the drawing, twelve address electrodes 65 (that is, Am, Am+1, . . . , Am+11) are required in total since four pixels are arranged in respective rows and each pixel requires three address electrodes. Further, as the resolution of PDPs becomes higher, discharge cells are required to be arranged more densely.

Accordingly, adjacent address electrodes 65 are required to be disposed closer together, and in this case, capacitance C between the adjacent address electrodes increases resulting in an increase of energy consumption (which is calculated as $CV^2f$) of the PDP.

In addition, as shown in FIG. 6, in the PDP with the delta-shaped rib structure, discharge cells form separate spaces partitioned by barrier ribs. Each pixel 71 of such a PDP includes three adjacent discharge cells 71R, 71G, 71B of respectively red, green, and blue colors that are arranged in a triangular pattern. Address electrodes 75 are formed to cross corresponding discharge cells among the discharge cells 71R, 71G, 71B forming the pixels 71.

In this case also, regarding sixteen pixels 71 shown in the drawing, twelve address electrodes 75 (that is, Am, Am+1, . . . , Am+11) are required in total since four pixels are arranged in respective rows and each pixel requires three address electrodes. In this case also, discharge cells are required to be arranged more densely as the resolution of PDPs becomes higher. Consequently, adjacent address electrodes 75 are required to be disposed closer together, and in this case, capacitance C between the adjacent address electrodes increases resulting in an increase of energy consumption (which is calculated as $CV^2f$) of the PDP.

SUMMARY OF THE INVENTION

The present invention has been made in an effort to provide a PDP having advantages of a reduced number of address electrodes corresponding to each pixel, thereby minimizing an increase of power consumption for a PDP of higher resolution as well as reducing manufacturing cost of the PDP.

An exemplary plasma display panel according to an embodiment of the present invention includes a front substrate and a rear substrate having opposing surfaces and a plurality of discharge cells partitioned in a space therebetween, a plurality of address electrodes formed along a first direction between the front and rear substrates, and a plurality of display electrodes formed along a second direction between the front and rear substrates and electrically separated from the plurality of address electrodes. Here, at least two discharge cells among a plurality of discharge cells included in respective pixels correspond to a same address electrode so as to be driven thereby.

The at least two discharge cells corresponding to the same address electrode may have phosphor layers of different colors.

The plurality of display electrodes may include a plurality of pairs of a sustain electrode and a scan electrode that correspond to respective discharge cells. In addition, the numbers of scan electrodes and address electrodes corresponding to each pixel may satisfy a ratio of "the number of address electrodes: the number of scan electrodes=8:3".

The plurality of display electrodes may respectively include a pair of protrusion electrodes formed at a borderline between adjacent discharge cells and protruding therefrom toward centers of the adjacent discharge cells. The plurality of scan electrodes may be formed along borderlines between pairs of adjacent discharge cells and may apply a common voltage to the pairs of adjacent discharge cells.

The pixels may respectively include discharge cells of red, green, and blue colors. In this case, the pixels may respectively include three discharge cells, and centers of the three discharge cells may be arranged in a triangular pattern. The discharge cells may be respectively formed in a shape of a hexagon or a rectangle. A borderline between a pair of discharge cells adjacent along the first direction may be formed such that it may cross, when extended, centers of discharge cells adjacent along the second direction.

In addition, two subpixels among a plurality of subpixels included in each pixel may be arranged adjacent to each other along the second direction.

In an exemplary PDP according to another embodiment of the present invention, discharge cells of at least two different colors may correspond to a same address electrode. In this case, discharge cells of all of red, green, and blue colors may correspond to the same address electrode.

Each of a pair of discharge cells corresponding to the same address electrode and adjacently formed along the first direction may have a phosphor layer of a different color.

In an exemplary PDP according to yet another exemplary embodiment of the present invention, two address electrodes correspond to each pixel including a plurality of discharge cells. In this case, ¾ of a scan electrode may correspond to each pixel.

As described above, in a PDP according to an exemplary embodiment of the present invention, an arrangement of pixels is enhanced such that at least two subpixels among a plurality of discharge cells included in respective pixels correspond to the same address electrode. Therefore, the number of address electrodes corresponding to each pixel is reduced and thus an increase of address power consumption for a higher resolution panel may be reduced.

In addition, since the number of address electrodes required for the entire panel is reduced, the manufacturing cost of a PDP may be reduced.

DETAILED DESCRIPTION

Figure 1:
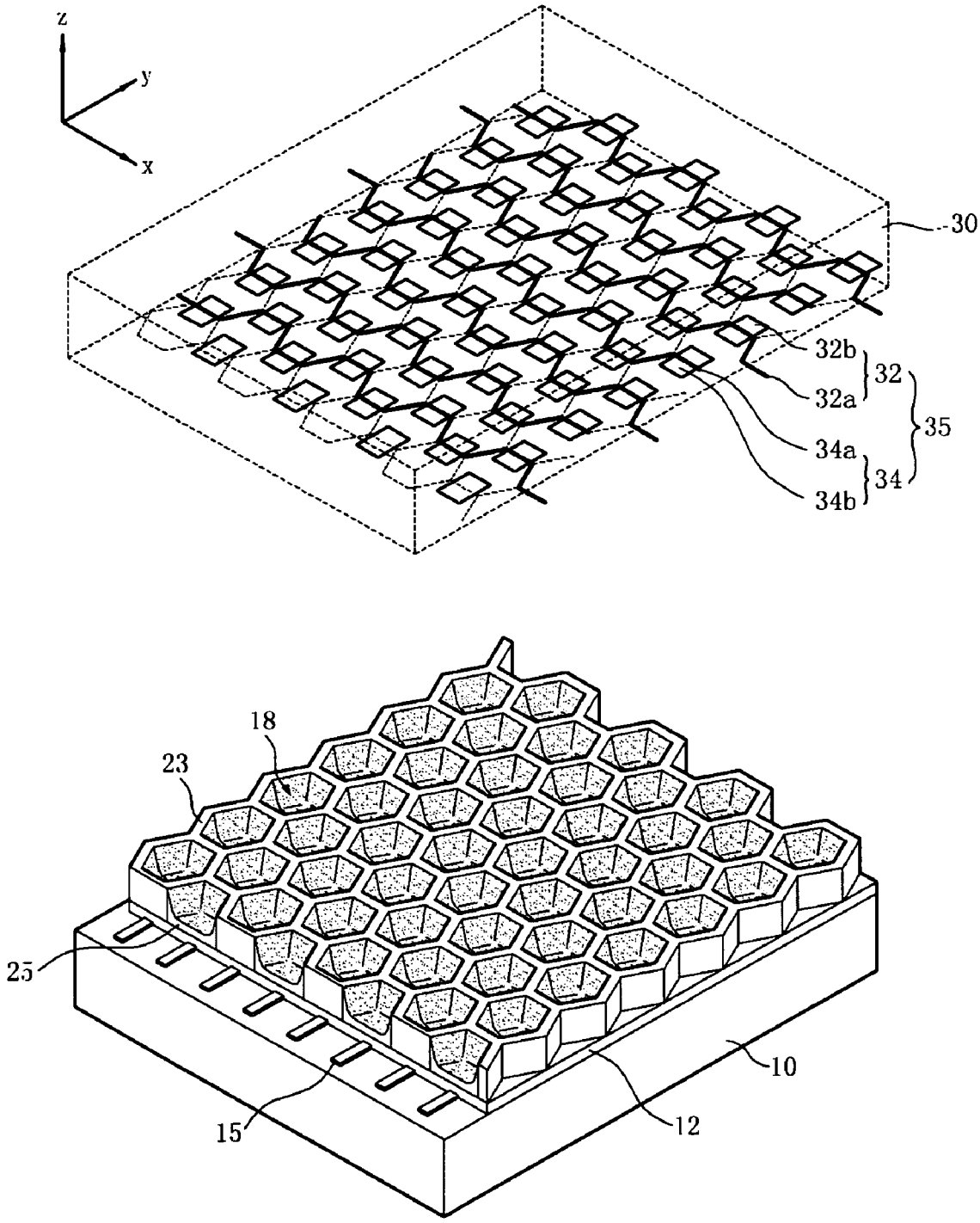
FIG. 1 is an exploded perspective view of a PDP according to a first exemplary embodiment of the present invention.
Figure 2:
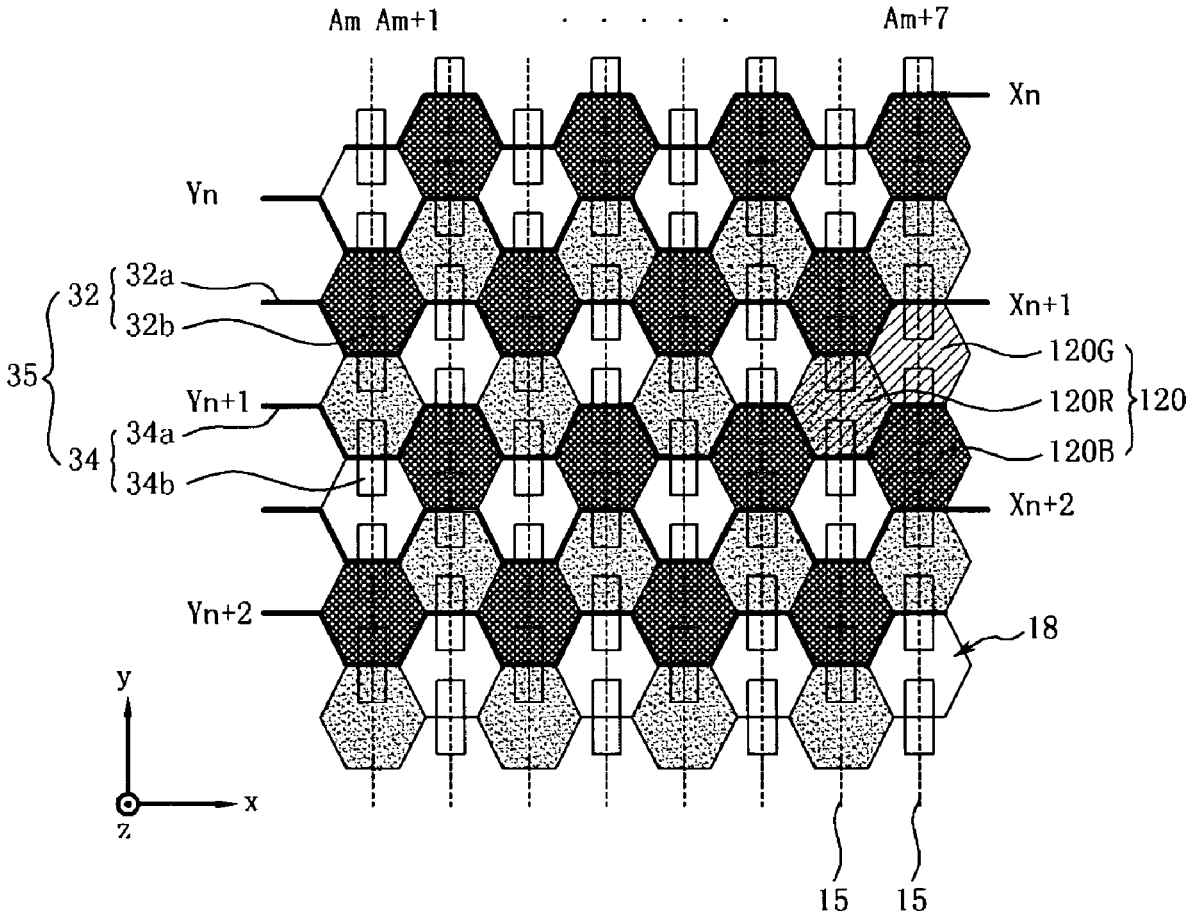
FIG. 2 is a top plan view partially showing an arrangement of pixels and electrodes of a PDP according to the first exemplary embodiment of the present invention.

As shown in FIGS. 1 and 2, a PDP according to the present exemplary embodiment is a so-called delta arrangement cell PDP in which three subpixels of red, green, and blue colors in each pixel are arranged in a triangular pattern.

The PDP includes a rear substrate 10 and a front substrate 30 disposed substantially in parallel and combined together with a predetermined space therebetween.

Barrier ribs 23 having a predetermined height and pattern and partitioning pixels 120 are formed between the rear substrate 10 and the front substrate 30. Here, each pixel 120 includes three subpixels 120R, 120G, 120B arranged in the above-mentioned triangular pattern.

The subpixels 120R, 120G, 120B are also partitioned by the barrier ribs 23, and they respectively have corresponding discharge cells 18.

According to the present exemplary embodiment, plan shapes of the respective subpixels 120R, 120G, 120B are formed in a generally hexagonal shape, and the barrier ribs 23 partitioning them are formed in a hexagonal or honeycomb pattern. Therefore, the discharge spaces 18 of the respective subpixels 120R, 120G, 120B are formed in a shape of a hexagonal prism that is open at its top.

The discharge cells 18 are provided with a plasma gas including xenon Xe, neon Ne, etc, for the plasma discharge. Phosphor layers 25 of red, green, and blue colors are respectively formed in the subpixels 120R, 120G, 120B of red, green, and blue colors. Here, the phosphor layers 25 are formed at bottoms of the discharge cells 18 and lateral sides of the barrier ribs 23.

In addition, on the rear substrate 10, a plurality of address electrodes 15 are spaced along a first direction (i.e., y-axis direction in the drawing) below the discharge cells 18 (in more detail, between the rear substrate and the barrier ribs). In addition, a dielectric layer 12 covering the address electrodes 15 is formed on an entire surface of the rear substrate 10, and it is also formed below the barrier ribs 23.

On the front substrate 30, a plurality of display electrodes 35 are spaced along a second direction (i.e., x-axis direction in the drawing). The display electrodes 35 include pairs of a sustain electrode 32 and a scan electrode 34, each pair of which forms a discharge gap and corresponds to respective discharge cells 18. In addition, the sustain electrode 32 and the scan electrode 34 respectively include bus electrodes 32*a*, 34*a* and transparent electrodes 32*b*, 34*b*. Here, the bus electrodes 32*a*, 34*a* are formed generally in parallel along the second direction (i.e., x-axis direction in the drawing) on the front substrate 30, and the transparent electrodes 32*b*, 34*b* protrude from the bus electrodes 32*a*, 34*a* into the discharge cell 18 of the subpixels 120R, 120G, 120B.

The bus electrodes 32*a*, 34*a* may be formed of a metallic material, and each one of them is formed in a zigzag pattern along its elongated direction since they are elongated along the barrier ribs 23. In order to minimize blocking of visible light generated in the discharge cells 18 during the operation of the PDP, the bus electrodes 32*a*, 34*a* may be formed with minimized widths and be disposed at the top of the barrier ribs 23.

The transparent electrodes 32*b*, 34*b* are formed of a transparent material such as indium-tin-oxide (ITO), and they respectively protrude from the bus electrodes 32*a*, 34*a* into a pair of discharge cells 18 adjacent to respective bus electrodes 32*a*, 34*a*. Therefore, in each discharge cell 18, a pair of transparent electrodes 32*b*, 34*b* are disposed facing each other with a predetermined gap therebetween.

In addition, on the front substrate 30, a dielectric layer (not shown) covering the display electrodes 35 may be applied to an entire surface of the front substrate 30, and a protective layer (not shown) formed of, e.g., MgO may be further applied thereon.

Hereinafter, an arrangement of pixels and electrodes of a PDP according to the first exemplary embodiment of the present invention will be described in more detail with particular reference to FIG. 2. According to the present exemplary embodiment, two address electrodes 15 correspond to each pixel 120. Here, each pixel 120 includes the three subpixels 120R, 120G, 120B of red, green, and blue colors, and centers of the subpixels 120R, 120G, 120B are arranged in the triangular pattern. For each pixel 120, at least two of the subpixels 120R, 120G, 120B are driven by the same address electrode 15.

In addition, according to the present exemplary embodiment, plan shapes of the discharge cells 18 of the respective subpixels 120R, 120G, 120B are formed in a generally hexagonal shape. A borderline between a pair of discharge cells 18 adjacent along the elongation direction (i.e., y-axis direction in the drawing) of an address electrode 15 is formed such that it may cross, when extended, centers of discharge cells adjacent along a direction (i.e., x-axis direction in the drawing) crossing the address electrode 15.

The scan electrodes 34 among the display electrodes 35 are formed along borderlines between pairs of the adjacent discharge cells 18, and the scan electrodes 34 apply a common voltage to the pairs of adjacent discharge cells 18. In the same way, the sustain electrodes 32 among the display electrodes 35 are formed along borderlines between pairs of the adjacent discharge cells 18, and the sustain electrodes 32 apply a common voltage to the pairs of adjacent discharge cells 18. Therefore, the scan electrodes 34 and the sustain electrodes 32 are alternately disposed along the elongation direction of the address electrode 15, and each of them controls the discharge of the pairs of discharge cells 18. For a scan electrode 34 passing through the pixels 120, three of four protruding transparent electrodes 34*b* lie within each pixel 120. That is, since each pixel 120 includes three subpixels, two protruding transparent electrodes 34*b* lying on the borderline between two subpixels and one protruding transparent electrode 34*b* lying on a boundary of the other subpixel lie within the pixel 120. Therefore, it may be regarded that ¾ of a scan electrode 34 corresponds to each pixel 120.

Since two address electrodes 15 and ¾ of a scan electrode 34 correspond to each pixel 120 in the present exemplary embodiment, the number of address electrodes 15 and scan electrodes 34 required for driving the PDP satisfies a ratio shown in the following Equation 1.

(Equation 1)

$$\text{the number of address electrodes:the number of scan electrodes}=8:3 \quad \text{(Equation 1)}$$

In the exemplary arrangement shown in FIG. 2, a total of sixteen pixels 120 are arranged in the partial view since four columns of pixels 120 are arranged in the horizontal direction and four rows of pixels 120 are arranged in the vertical direction. Since two address electrodes 15 correspond to each column of pixels 120, a total of eight address electrodes 15 (that is, Am to Am+7) correspond to all columns of pixels 120 shown in the drawing. In addition, since ¾ of a scan electrode 34 corresponds to each row of pixels 120, a total of three scan electrodes 34 (that is, Yn, Yn+1, and Yn+2) correspond to all rows of pixels 120 shown in the drawing. The same as the scan electrodes 34, a total of three sustain electrodes 32 (that is, Xn, Xn+1, and Xn+2) correspond to all rows of pixels 120 shown in the drawing.

In such an arrangement of pixels, adjacent subpixels (for example, referring to the subpixels indicated by the reference numerals 120G, 120B) on the same address electrode 15 have phosphor layers of different colors. In such a way, subpixels having phosphor layers of the three different colors may be alternately arranged on the same address electrode 15.

Figure 5:
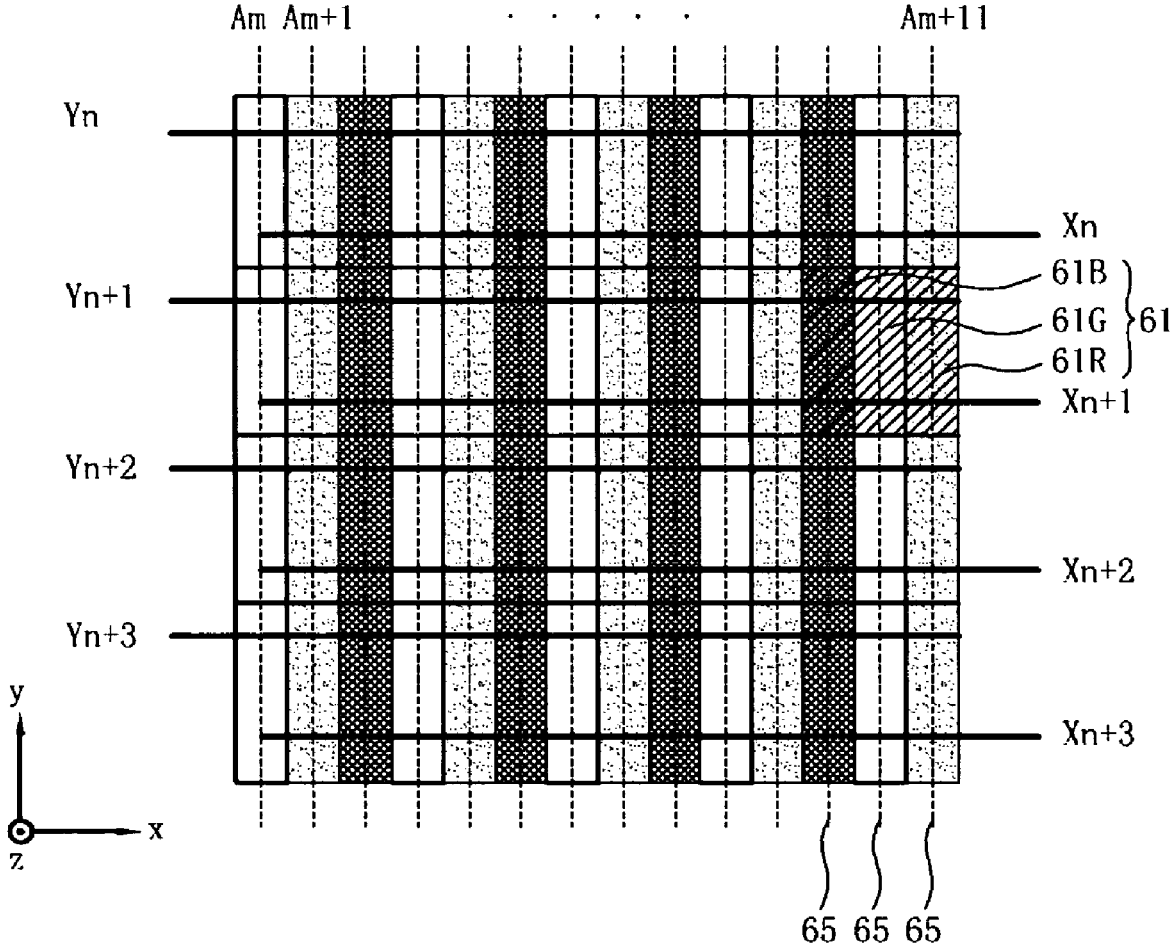
FIG. 5 (PRIOR ART)
FIG. 5 is a top plan view partially showing a stripe arrangement of pixels and electrodes of a conventional PDP.
Figure 6:
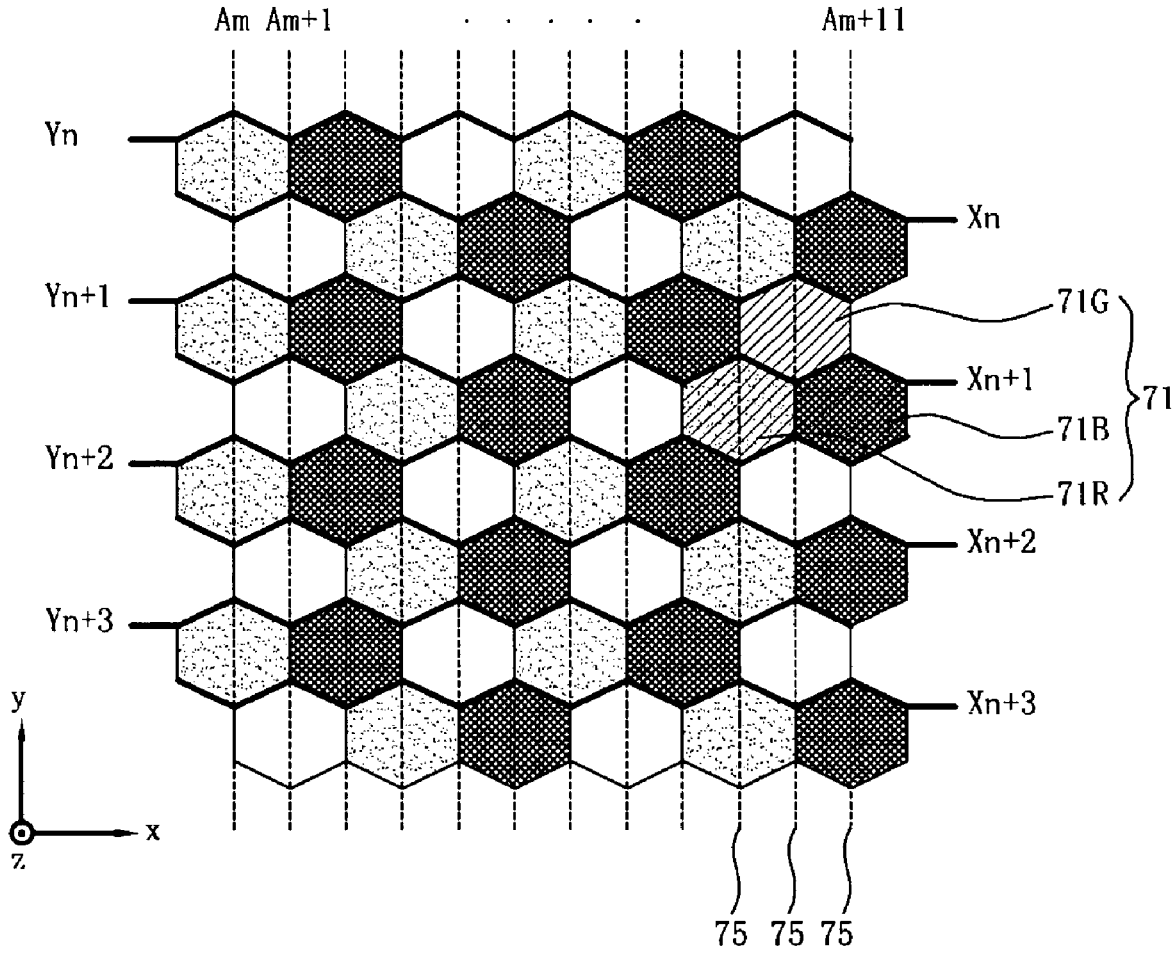
FIG. 6 (PRIOR ART)
FIG. 6 is a top plan view partially showing a delta arrangement of pixels and electrodes of a conventional PDP.

In comparison with the conventional PDPs shown in FIG. 5 and FIG. 6, only eight address electrodes are required to drive sixteen pixels arranged in a matrix pattern of 4×4 according to the present exemplary embodiment, while a total of twelve address electrodes are required to drive sixteen pixels arranged in a conventional matrix pattern. Therefore, the number of address electrodes required to drive the same number of pixels may be reduced.

Figure 3:
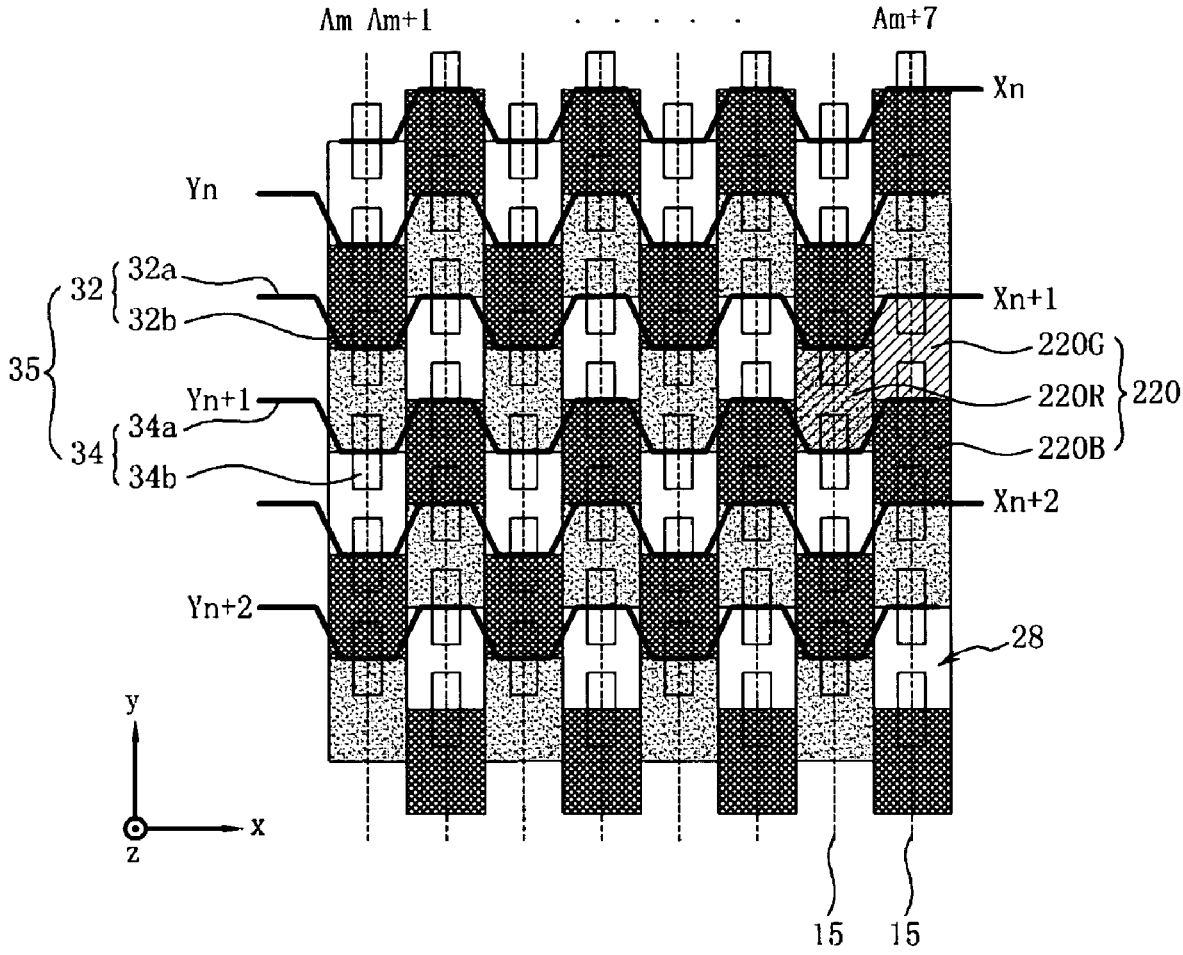
FIG. 3 is a top plan view partially showing an arrangement of pixels and electrodes of a PDP according to a second exemplary embodiment of the present invention.

FIG. 3 is a top plan view partially showing an arrangement of pixels and electrodes of a PDP according to a second exemplary embodiment of the present invention.

According to the present exemplary embodiment, plan shapes of the discharge cells 28 of the respective subpixels 220R, 220G, 220B are formed in a generally rectangular shape. A borderline between a pair of discharge cells 28 adjacent along the elongation direction (i.e., y-axis direction in the drawing) of an address electrode 15 is formed such that it may cross, when extended, centers of discharge cells adjacent along a direction (i.e., x-axis direction in the drawing) crossing the address electrode 15.

As seen in FIG. 3, according to the present exemplary embodiment, two address electrodes 15 correspond to each pixel 220. Here, each pixel 220 includes the three subpixels 220R, 220G, 220B of red, green, and blue colors, and centers of the subpixels 220R, 220G, 220B are arranged in the triangular pattern. For each pixel 220, at least two of the subpixels 220R, 220G, 220B are driven by the same address electrode 15.

The scan electrodes 34 among the display electrodes 35 are formed along borderlines between pairs of adjacent discharge cells 28, and the scan electrodes 34 apply a common voltage to the pairs of adjacent discharge cells 28. In the same way, the sustain electrodes 32 among the display electrodes 35 are formed along borderlines between pairs of adjacent discharge cells 28, and the sustain electrodes 32 apply a common voltage to the pairs of adjacent discharge cells 28. Therefore, the scan electrodes 34 and the sustain electrodes 32 are alternately disposed along the elongation direction of the address electrode 15, and each of them controls the discharge of the pairs of discharge cells 28.

For a scan electrode passing through the pixels 220, three of four protruding transparent electrodes 34*b* lie within each pixel 220. That is, since each pixel 120 includes three subpixels, two protruding transparent electrodes 34*b* lying on the borderline between two subpixels and one protruding transparent electrode 34*b* lying on a boundary of the other subpixel lie within the pixel 220. Therefore, it may be regarded that ¾ of a scan electrode 34 corresponds to each pixel 220. Therefore, according to the present exemplary embodiment, the number of address electrodes 15 and scan electrodes 34 required for driving the PDP satisfies a ratio shown in the above Equation 1, the same as in the first exemplary embodiment.

In the exemplary arrangement shown in FIG. 3, a total of sixteen pixels 220 are arranged in the partial view since four columns of pixels 220 are arranged in the horizontal direction and four rows of pixels 220 are arranged in the vertical direction. Since two address electrodes 15 correspond to each column of pixels 220, a total of eight address electrodes 15 (that is, Am to Am+7) correspond to all columns of pixels 220 shown in the drawing. In addition, since ¾ of a scan electrode 34 corresponds to each row of pixels 220, a total of three scan electrodes 34 (that is, Yn, Yn+1, and Yn+2) correspond to all rows of pixels 220 shown in the drawing. The same as the scan electrodes 34, a total of three sustain electrodes 32 (that is, Xn, Xn+1, and Xn+2) correspond to all rows of pixels 220 shown in the drawing.

In such an arrangement of pixels, adjacent subpixels (for example, referring to the subpixels indicated by the reference numerals 220G, 220B) on the same address electrode 15 have phosphor layers of different colors. In such a way, subpixels having phosphor layers of the three different colors may be alternately arranged on the same address electrode 15.

In comparison with the conventional PDPs shown in FIG. 5 and FIG. 6, only eight address electrodes are required to drive sixteen pixels arranged in a matrix pattern of 4×4 according to the present exemplary embodiment, while a total of twelve address electrodes are required to drive sixteen pixels arranged in a conventional matrix pattern. Therefore, the number of address electrodes required to drive the same number of pixels may be reduced.

Figure 4:
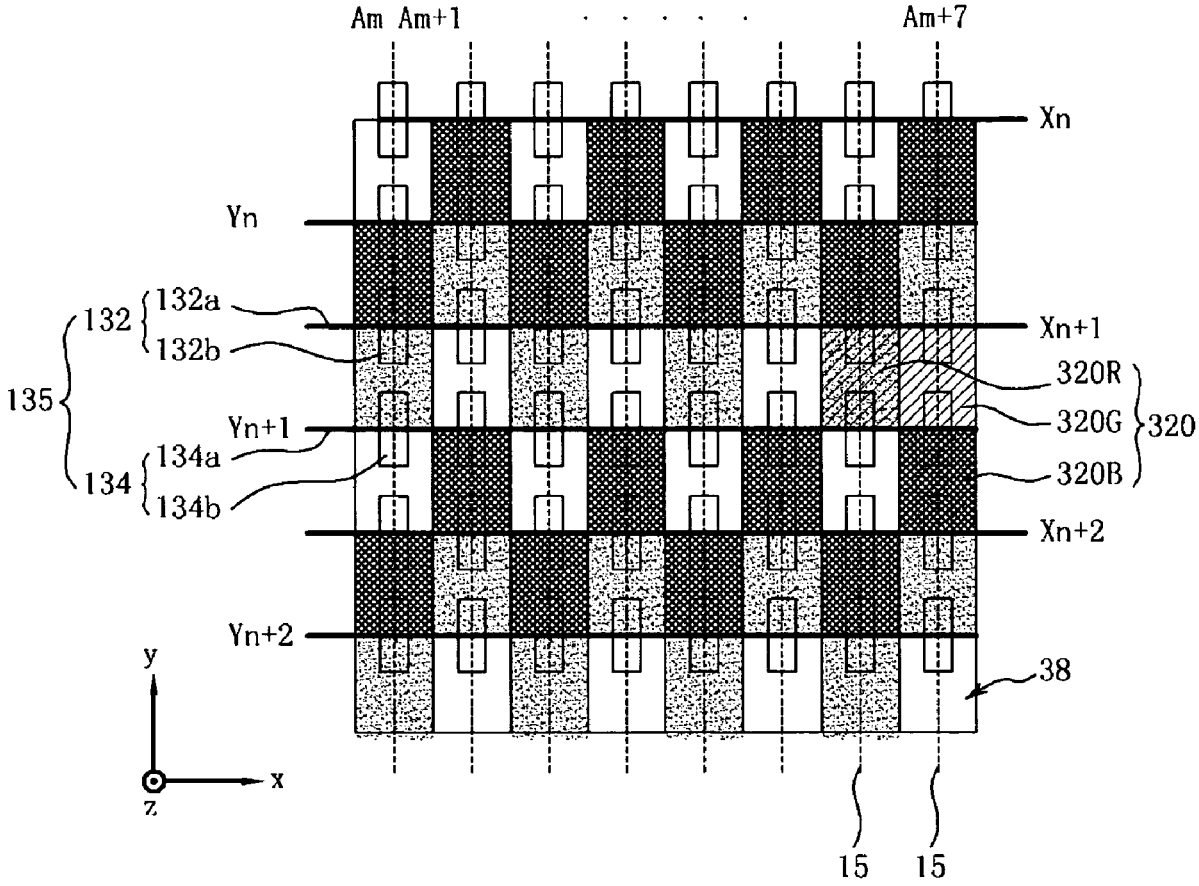
FIG. 4 is a top plan view partially showing an arrangement of pixels and electrodes of a PDP according to a third exemplary embodiment of the present invention.

FIG. 4 is a top plan view partially showing an arrangement of pixels and electrodes of a PDP according to a third exemplary embodiment of the present invention.

As shown in the drawing, according to the present exemplary embodiment, plan shapes of discharge cells 38 of the respective subpixels 320R, 320G, 320B are formed in a generally rectangular shape. In addition, centers of the subpixels 320R, 320G, 320B are arranged in a right triangular pattern. Therefore, two subpixels among the three subpixels 320R, 320G, 320B are adjacently arranged along the elongation direction of an address electrode 15, and two subpixels thereamong are adjacently arranged along the direction crossing the address electrode 15.

As seen in FIG. 4, according to the present exemplary embodiment, two address electrodes 15 correspond to each pixel 320. Here, each pixel 320 includes the three subpixels 320R, 320G, 320B of red, green, and blue colors. For each pixel 320, at least two of the subpixels 320R, 320G, 320B are driven by the same address electrode 15.

Scan electrodes 134 among display electrodes 135 are formed along borderlines between pairs of adjacent discharge cells 38, and the scan electrodes 134 apply a common voltage to the pairs of adjacent discharge cells 38. In the same way, sustain electrodes 132 among the display electrodes 135 are formed along borderlines between pairs of adjacent discharge cells 38, and the sustain electrodes 132 apply a common voltage to the pairs of adjacent discharge cells 38. Therefore, the scan electrodes 134 and the sustain electrodes 132 are alternately disposed along the elongation direction of the address electrode 15, and each of them controls the discharge of the pairs of discharge cells 38.

For a scan electrode passing through the pixels 320, three of four protruding transparent electrodes 134*b* lie within each pixel 320. That is, since each pixel 320 includes three subpixels, two protruding transparent electrodes 134*b* lying on the borderline between two subpixels and one protruding transparent electrode 134*b* lying on a boundary of the other subpixel lie within the pixel 320. Therefore, it may be regarded that ¾ of a scan electrode 134 corresponds to each pixel 320. Therefore, according to the present exemplary embodiment, the number of address electrodes 15 and scan electrodes 134 required for driving the PDP satisfies a ratio shown in the above Equation 1, the same as in the first exemplary embodiment.

In the exemplary arrangement shown in FIG. 4, a total of sixteen pixels 320 are arranged in the partial view, since four columns of pixels 320 are arranged in the horizontal direction and four rows of pixels 320 are arranged in the vertical direction. Since two address electrodes 15 correspond to each column of pixels 320, a total of eight address electrodes 15 (that is, Am to Am+7) correspond to all columns of pixels 320 shown in the drawing. In addition, since ¾ of a scan electrode 134 corresponds to each row of pixels 320, a total of three scan electrodes 134 (that is, Yn, Yn+1, and Yn+2) correspond to all rows of pixels 320 shown in the drawing. The same as the scan electrodes 134, a total of three sustain electrodes 132 (that is, Xn, Xn+1, and Xn+2) correspond to all rows of pixels 320 shown in the drawing.

In such an arrangement of pixels, adjacent subpixels (for example, refer to the subpixels indicated by the reference numerals 320G, 320B) on the same address electrode 15 have phosphor layers of different colors. In such a way, subpixels having phosphor layers of the three different colors may be alternately arranged on the same address electrode 15.

In comparison with the conventional PDPs shown in FIG. 5 and FIG. 6, only eight address electrodes are required to drive sixteen pixels arranged in a matrix pattern of 4×4 according to the present exemplary embodiment, while a total of twelve address electrodes are required to drive sixteen pixels arranged in a conventional matrix pattern. Therefore, the number of address electrodes required to drive the same number of pixels may be reduced.

In the following Table 1, the number of required address electrode terminals, power consumption, etc., are compared between a PDP according to an exemplary embodiment of the present invention and a PDP according to several comparative examples.

Exemplary Embodiment 1 denotes a PDP of a dual driving scheme having a resolution of 1920×1080 (FHD resolution) according to an exemplary embodiment of the present invention. Comparative Example 1 denotes a PDP of a dual driving scheme having a stripe arrangement of subpixels and achieving the resolution of 1920×1080 (FHD resolution). Comparative Example 2 denotes a PDP of a dual driving scheme having a delta arrangement of subpixels and achieving the resolution of 1920×1080 (FHD resolution). Comparative Example 3 denotes a PDP of a dual driving scheme having a stripe (or delta) arrangement of subpixels and achieving the resolution of 1920×1080 (FHD resolution). Comparative Example 4 denotes a PDP of a dual driving scheme having a stripe (or delta) arrangement of subpixels and achieving a resolution of 1366×768. Comparative Example 5 denotes a PDP of a dual driving scheme having a stripe (or delta) arrangement of subpixels and achieving a resolution of 1280×720.

In the following Table 1, address electrode power consumption, heat per address electrode circuit, and peak power per address electrode circuit are shown in relative values in comparison with values of Comparative Example 4.

TABLE 1

| | Number of address electrode terminals | TCP | Number of address buffers | Address power consumption (relative value) | Heat per address circuit (relative value) | Peak power per address circuit (relative value) | Number of scan electrode terminals | Number of scan electrode |
|---|---|---|---|---|---|---|---|---|
| Exemplary Embodiment 1 | 3840 | 80 | 2 | 0.93 | 0.49 | 0.47 | 810 | 13 |
| Comparative Example 1 | 5760 | 120 | 2 | 1.39 | 0.49 | 0.70 | 1080 | 17 |
| Comparative Example 2 | 5760 | 120 | 2 | 1.39 | 0.49 | 0.70 | 1080 | 17 |
| Comparative Example 3 | 5760 | 60 | 1 | 2.78 | 1.98 | 1.41 | 1080 | 17 |
| Comparative Example 4 | 4098 | 43 | 1 | 1.00 | 1.00 | 1.00 | 768 | 12 |

TABLE 1-continued

| | Number of address electrode terminals | TCP | Number of address buffers | Address power consumption (relative value) | Heat per address circuit (relative value) | Peak power per address circuit (relative value) | Number of scan electrode terminals | Number of scan electrode |
|---|---|---|---|---|---|---|---|---|
| Comparative Example 5 | 3840 | 40 | 1 | 0.82 | 0.88 | 0.94 | 720 | 12 |

As shown in Table 1, when a PDP has the resolution of 1920×1080 (refer to Comparative Examples 1 to 3), the number of address electrodes is required to be 5760. When the numbers of address electrode terminals and scan lines increase, address power consumption accordingly increases. In addition, power consumption also increases since crosstalk and stray capacitance increases due to a shortening of the distance between adjacent discharge cells.

However, referring to Exemplary Embodiment 1 having the resolution of 1920×1080, the number of address electrode terminals thereof is substantially reduced to 3840. Therefore, as shown in Table 1, the PDP of Exemplary Embodiment 1 consumes less address power, generates less heat per address circuit, and has less peak power per address circuit than the PDPs of comparative examples having the same resolution.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display panel, comprising:

a front substrate and a rear substrate having opposing surfaces and a plurality of discharge cells partitioned in a space between the front substrate and the rear substrate, the plurality of discharge cells forming a plurality of pixels arranged into blocks;

a plurality of address electrodes formed along a first direction between the front substrate and the rear substrate; and a plurality of display electrodes formed along a second direction between the front substrate and the rear substrate and electrically separated from the plurality of address electrodes, wherein at least two discharge cells among the plurality of discharge cells included in a respective pixel of the pixels correspond to and are driven by a same address electrode, wherein the plurality of display electrodes comprise a plurality of pairs of a sustain electrode and a scan electrode that correspond to respective discharge cells, and wherein every 4×4 block of pixels corresponds to and is driven by eight address electrodes and three scan electrodes.

2. The plasma display panel of claim 1, wherein the at least two discharge cells corresponding to the same address electrode have phosphor layers of different colors.

3. The plasma display panel of claim 1, wherein the plurality of display electrodes respectively comprise a pair of protrusion electrodes formed at a borderline between adjacent discharge cells, each of the pair of protrusion electrodes protruding from the borderline toward respective centers of adjacent discharge cells.

4. The plasma display panel of claim 1, wherein the scan electrodes are formed along borderlines between pairs of adjacent discharge cells and apply a common voltage to the pairs of adjacent discharge cells.

5. The plasma display panel of claim 1, wherein each pixel respectively comprises discharge cells of red, green, and blue colors.

6. The plasma display panel of claim 1, wherein:

each pixel respectively comprises three discharge cells; and centers of the three discharge cells are arranged in a triangular pattern.

7. The plasma display panel of claim 1, wherein each of the discharge cells has a hexagonal plan shape.

8. The plasma display panel of claim 1, wherein each of the discharge cells has a rectangular plan shape.

9. The plasma display panel of claim 1, wherein a borderline between a pair of discharge cells adjacent along the first direction is formed such that the borderline may cross, when extended, centers of discharge cells adjacent along the second direction.

10. The plasma display panel of claim 1, wherein two subpixels among a plurality of subpixels included in each pixel are arranged adjacent to each other along the second direction.

11. The plasma display panel of claim 1, further comprising:

barrier ribs formed between the rear substrate and the front substrate and partitioning the pixels, wherein each of the display electrodes is formed in a zigzag pattern along the barrier ribs.

12. The plasma display panel of claim 1, wherein the plurality of pixels are further arranged into rows, wherein each of the plurality of display electrodes is adjacent to each other, and wherein each of the display electrodes corresponds to and is configured to drive more than one of the rows of pixels.

13. A plasma display panel, comprising:

a front substrate and a rear substrate having opposing surfaces and a plurality of discharge cells partitioned in a space between the front substrate and the rear substrate, the plurality of discharge cells forming a plurality of pixels arranged into blocks;

a plurality of address electrodes formed along a first direction between the front substrate and the rear substrate; and a plurality of display electrodes formed along a second direction between the front substrate and the rear substrate and electrically separated from the plurality of address electrodes, wherein discharge cells of at least two different colors correspond to a same address electrode, wherein the plurality of display electrodes comprise a plurality of pairs of a sustain electrode and a scan electrode that correspond to respective discharge cells, and wherein every 4×4 block of pixels corresponds to and is driven by eight address electrodes and three scan electrodes.

14. The plasma display panel of claim 13, wherein discharge cells of red, green, and blue colors correspond to the same address electrode.

15. The plasma display panel of claim 13, wherein each of a pair of discharge cells corresponding to a same address electrode and adjacently formed along the first direction has a phosphor layer of a different color.

16. The plasma display panel of claim 13, wherein the plurality of display electrodes respectively comprise a pair of protrusion electrodes formed at a borderline between adjacent discharge cells, each of the pair of protrusion electrodes protruding from the borderline toward respective centers of adjacent discharge cells.

17. The plasma display panel of claim 13, wherein each of the discharge cells has a hexagonal plan shape.

18. The plasma display panel of claim 13, wherein each pixel respectively comprises discharge cells of red, green, and blue colors.

19. The plasma display panel of claim 13, wherein:

each pixel respectively comprises three discharge cells; and centers of the three discharge cells are arranged in a triangular pattern.

20. A plasma display panel, comprising:

a front substrate and a rear substrate having opposing surfaces and a plurality of discharge cells partitioned in a space between the front substrate and the rear substrate, the plurality of discharge cells forming a plurality of pixels arranged into blocks;

a plurality of address electrodes formed along a first direction between the front substrate and the rear substrate; and a plurality of display electrodes formed along a second direction between the front and rear substrates and electrically separated from the plurality of address electrodes, wherein the plurality of display electrodes include a plurality of pairs of a sustain electrode and a scan electrode that correspond to respective discharge cells, and wherein every 4×4 block of pixels corresponds to and is driven by eight address electrodes and three scan electrodes, and a ratio of numbers of address electrodes to numbers of scan electrodes per pixel is 8:3.

21. The plasma display panel of claim 20, wherein each of a pair of discharge cells corresponding to a same address electrode and adjacently formed along the first direction has a phosphor layer of a different color.

22. The plasma display panel of claim 20, wherein the plurality of display electrodes respectively comprise a pair of protrusion electrodes formed at a borderline between adjacent discharge cells, each of the pair of protrusion electrodes protruding from the borderline toward respective centers of the adjacent discharge cells.

23. The plasma display panel of claim 20, wherein each of the discharge cells has a hexagonal plan shape.

24. The plasma display panel of claim 20, wherein each pixel respectively comprises discharge cells of red, green, and blue colors.

25. The plasma display panel of claim 20, wherein:

each pixel respectively comprises three discharge cells; and centers of the three discharge cells are arranged in a triangular pattern.

26. A plasma display panel, comprising:

a front substrate and a rear substrate having opposing surfaces and a plurality of discharge cells partitioned in a space between the front substrate and the rear substrate, the plurality of discharge cells forming a plurality of rows of pixels;

a plurality of address electrodes formed along a first direction between the front substrate and the rear substrate; and a plurality of display electrodes formed along a second direction between the front and rear substrates and electrically separated from the plurality of address electrodes, the plurality of display electrodes being adjacent to each other, wherein two address electrodes correspond to each pixel, wherein the plurality of display electrodes comprise a plurality of pairs of a sustain electrode and a scan electrode that correspond to respective discharge cells, and wherein every 4×4 block of pixels corresponds to and is driven by eight address electrodes and three scan electrodes.

27. The plasma display panel of claim 26, wherein ¾of a scan electrode corresponds to each pixel.

28. The plasma display panel of claim 26, wherein the plurality of display electrodes respectively comprise a pair of protrusion electrodes formed at a borderline between adjacent discharge cells, each of the pair of protrusion electrodes protruding from the borderline toward respective centers of adjacent discharge cells.

29. The plasma display panel of claim 26, wherein the plurality of scan electrodes are formed along borderlines between pairs of adjacent discharge cells and apply a common voltage to the pairs of adjacent discharge cells.

30. The plasma display panel of claim 26, wherein each pixel respectively comprises discharge cells of red, green, and blue colors.

31. The plasma display panel of claim 26, wherein:

each pixel respectively comprises three discharge cells; and centers of the three discharge cells are arranged in a triangular pattern.

32. The plasma display panel of claim 26, wherein each discharge cells has a hexagonal plan shape.

33. The plasma display panel of claim 26, wherein a borderline between a pair of discharge cells adjacent along the first direction is formed such that it may cross, when extended, centers of discharge cells adjacent along the second direction.

* * * * *

UNITED STATES PATENT AND TRADEMARK OFFICE

CERTIFICATE OF CORRECTION

PATENT NO. : 7,750,565 B2
APPLICATION NO. : 11/438803
DATED : July 6, 2010
INVENTOR(S) : Sang-Hoon Yim It is certified that error appears in the above-identified patent and that said Letters Patent is hereby corrected as shown below:

In the Claims

| | |
|---|---|
| Column 12, Claim 27, line 35 | Delete "3/4of" Insert -- 3/4 of -- |
| Column 12, Claim 32, line 56 | Delete "cells" Insert -- cell -- |

Signed and Sealed this
Eleventh Day of October, 2011

David J. Kappos

David J. Kappos
*Director of the United States Patent and Trademark Office*